US009834972B2

(12) United States Patent
Xu

(10) Patent No.: US 9,834,972 B2
(45) Date of Patent: Dec. 5, 2017

(54) ANTI-JUMPING UPPER WHEEL DEVICE WITH DOUBLE DAMPERS

(71) Applicant: Jiangde Xu, Guangdong (CN)

(72) Inventor: Jiangde Xu, Guangdong (CN)

(73) Assignee: ZHONGSHAN OPIKE HARDW ARE PRODUCT CO., LTD, Zhongshan (CN)

( * ) Notice: Subject to any disclaimer, the term of this patent is extended or adjusted under 35 U.S.C. 154(b) by 69 days.

(21) Appl. No.: 14/784,287

(22) PCT Filed: Apr. 8, 2014

(86) PCT No.: PCT/CN2014/074903

§ 371 (c)(1),
(2) Date: Oct. 14, 2015

(87) PCT Pub. No.: WO2014/169771

PCT Pub. Date: Oct. 23, 2014

(65) Prior Publication Data

US 2016/0032967 A1 Feb. 4, 2016

(30) Foreign Application Priority Data

Apr. 15, 2013 (CN) ..... 2013 2 0188516 U
Jul. 8, 2013 (CN) ..... 2013 2 0403640 U

(51) Int. Cl.
*E05F 5/00* (2017.01)
*E05F 1/16* (2006.01)
(Continued)

(52) U.S. Cl.
CPC ..... *E05F 5/003* (2013.01); *E05F 1/16* (2013.01); *E05F 5/027* (2013.01);
(Continued)

(58) Field of Classification Search
CPC ..... E05F 1/16; E05F 5/003; E05F 5/027
See application file for complete search history.

(56) References Cited

U.S. PATENT DOCUMENTS 5,207,781 A * 5/1993 Rock ..... A47B 88/467 312/319.1
6,848,759 B2 * 2/2005 Doornbos ..... E05F 1/16 16/64

(Continued)

FOREIGN PATENT DOCUMENTS

CN 203145671 U 8/2013

*Primary Examiner* — Jeffrey O Brien

(57) ABSTRACT

An anti-jumping upper wheel device with double dampers comprises of an anti-jumping upper wheel assembly with double damper (10) being comprised of an upper wheel plate (11), an upper wheel (12), an upper wheel cover (13) and double dampers (14) and a pulling unit (20); wherein, an anti-jumping roller (17) is mounted to the upper wheel cover (13); the pulling unit (20) is a double-plate pulling unit which is comprised of a baseplate of pulling unit (21) and a pillar plate of pulling unit (22) mounted above it; a pulling pillar (221) is fixed vertically on the pillar plate of pulling unit (22); wherein, connecting elastic units (23, 24) are overlapped and connected in parallel to three branch plates (2131, 2132, 2133, 2141, 2142, 2143) mounted on longitudinal direction in parallel of both ends on longitudinal direction of the baseplate of pulling unit (21).

9 Claims, 17 Drawing Sheets

(51) Int. Cl.
*E05F 5/02* (2006.01)
*E05D 15/06* (2006.01)

(52) U.S. Cl.
CPC ..... *E05D 15/0691* (2013.01); *E05Y 2201/692* (2013.01); *E05Y 2600/10* (2013.01); *E05Y 2600/12* (2013.01); *E05Y 2600/626* (2013.01); *E05Y 2800/21* (2013.01); *E05Y 2800/24* (2013.01); *E05Y 2800/422* (2013.01); *E05Y 2900/132* (2013.01); *Y10T 16/364* (2015.01)

(56) References Cited

U.S. PATENT DOCUMENTS 7,028,370 B2 * 4/2006 Hoshide ..... E05F 1/16 16/90
7,281,773 B2 * 10/2007 Sato ..... E05F 1/16 312/333
7,743,464 B2 * 6/2010 Tomioka ..... E05F 3/102 16/49
7,866,003 B2 * 1/2011 Tooyama ..... E05F 5/003 16/422
7,945,993 B2 * 5/2011 Tomioka ..... E05F 3/102 16/49
7,980,640 B2 * 7/2011 Yang ..... A47B 88/493 312/319.1
8,085,532 B2 * 12/2011 Tseng ..... E05B 17/0033 361/679.58
8,186,010 B2 * 5/2012 Tomiji ..... E05F 5/027 16/62
8,307,497 B2 * 11/2012 Chang ..... E05F 5/003 16/49
8,459,758 B2 * 6/2013 Rechberg ..... E05F 3/108 312/319.1
8,651,597 B2 * 2/2014 Kimura ..... E05F 3/00 312/319.1
8,671,520 B2 * 3/2014 Tanno ..... E05F 1/16 16/49
8,714,671 B2 * 5/2014 Huang ..... A47B 88/467 312/319.2
8,726,574 B2 * 5/2014 Iwaki ..... E05F 1/16 16/49
8,745,821 B2 * 6/2014 Chang ..... E05F 5/003 16/49
8,746,422 B2 * 6/2014 Zimmer ..... E05F 1/16 188/265
8,931,138 B2 * 1/2015 Shimizu ..... E05F 1/16 16/49
8,984,810 B2 * 3/2015 Bortoluzzi ..... E05D 15/1042 312/139
9,009,918 B2 * 4/2015 Haab ..... E05D 15/0652 16/105
9,121,210 B2 * 9/2015 Rioja Calvo ..... E05F 1/16
9,435,152 B2 * 9/2016 Zimmer ..... E05F 1/16
2001/0008037 A1 * 7/2001 Brustle ..... E05F 1/16 16/71
2005/0212302 A1 * 9/2005 Fisher ..... E05B 81/14 292/216
2009/0096339 A1 * 4/2009 Worner ..... E05F 1/16 312/334.44
2014/0026358 A1 * 1/2014 Saito ..... E05F 5/003 16/72
2014/0033475 A1 * 2/2014 Saito ..... E05F 1/16 16/49
2016/0340917 A1 * 11/2016 Zimmer ..... E05F 5/003
2016/0340955 A1 * 11/2016 Zimmer ..... E05F 5/003

* cited by examiner

ANTI-JUMPING UPPER WHEEL DEVICE WITH DOUBLE DAMPERS

FIELD OF THE INVENTION

The present invention relates to the field of manufacture of hardware accessory for architectural decoration, especially relates to an upper wheel for a sliding door, and more especially relates to an anti-jumping upper wheel device with double dampers.

BACKGROUND OF THE INVENTION

There are several kinds of damper assemblies used in cupboard doors (sliding doors), dampers in a general damper assembly for a sliding door are used in relative left and right sides, and therefore the assembly requirement thereof is rigid; and while usually the damper assembly has only one damper and thus has limited damping force. Under the aforementioned prior art, if there is need to enhance damping force, two dampers for a damper assembly in both left and right sides may be required. Accordingly, pulling sheets would be needed to being arranged respectively with the tracks of dampers. As such, the whole structure would get complicated, bringing about higher assembly requirements.

In order to overcome the abovementioned defects, applicant of the present invention researched an upper wheel assembly with double dampers for the cupboard door and have a patent (patent No. 201320065103.7) on it, wherein two dampers in parallel are assembled in a cover of the upper wheel assembly with double dampers for cupboard door, and a pulling unit is assembled to a common fore-head of the two dampers which can pull or push both dampers simultaneously, so as to achieve the "stretch" and damping effect with cooperation of other units. For assembling, fixing the upper wheel assembly with double dampers on upper end of the door leaf, and fixing a pulling unit upside-down in the upper track by screw, and plugging a sliding pillar of the pulling unit into a circular arc groove of a damper sliding sheet of the upper wheel assembly with double dampers, in order to pull and push the damper sliding sheet.

However, with applying of the above-mentioned patented technology, the applicant found a problem to be solved that the door leaf jumps at the time of being open and closed because of accelerated velocity. In addition, problem of assembly of the pulling unit also needs to be solved, because assembly of the pulling unit into the upper track is not firm enough that the pulling unit is prone to drop when the door is pulled and pushed for much times. Moreover, the pulling pillar should be long enough to plug into the circular arc groove of the damper sliding sheet, while in fact it is not long enough as it is fixed on a base of the pulling unit which is assembled in the upper track, and it thus is prone to fall off the circular arc groove, and therefore the problem about the effective length of the pulling pillar of the pulling unit needs to be solved.

For the above, it is necessary to improve the above-mentioned technology.

SUMMARY OF THE INVENTION

In order to solve the problem of door leaf jumping in the prior art, the patent filed on 15th Apr., 2013 by the applicant named "anti-jumping upper wheel assembly with double dampers for cupboard door" (Application No. CN201320188516.4) provides a technical solution: mounting an anti-jumping roller vertically in the cover of the upper wheel assembly with double dampers for cupboard door, and the patent also provides a double-plate pulling unit to solve the problem about assembly of the pulling unit and effective length of the pulling pillar, but with applying defects also exit. For this purpose, the applicant further researched and got an improved double-plate pulling unit on which a patent application on $8^{th}$ Jul., 2013 (Application No. CN201320403640.8) is filed, which can adjust height of the pulling pillar and thus ensure effective length of the pulling pillar, and make assembly easier and firmer.

The present invention claims right of priority of the above-mentioned two patents, whose technical solution will be cited into the present application.

The present invention aims to provide an anti-jumping upper wheel assembly with double dampers, which can anti jumping of the door leaf, and whose pulling unit is easy to be assembled and is firm, and whose pulling unit cooperates well with the damper sliding unit.

In order to achieve the above aim, the present invention provides the following technical solution:

An anti-jumping upper wheel device with double dampers comprising an anti-jumping upper wheel assembly with double dampers and a pulling unit; wherein the anti-jumping upper wheel assembly comprises an upper wheel plate, a upper wheel and an upper wheel cover, wherein the upper wheel and the upper wheel cover are mounted on said upper wheel plate; dampers are connected to a damper sliding unit at an end and mounted in longitudinal direction in said upper wheel cover on said upper wheel plate;

the pulling unit are adapted for an upper track in which a door leaf is mounted, such that the pulling unit is capable of pulling said damper sliding unit; wherein, an extension spring is mounted in parallel with and between said two dampers; a connecting unit is connected to said damper sliding unit, and heads of drawbars of said dampers and the corresponding end of said extension spring are connected to said connecting unit;

an anti-jumping roller is mounted onto said upper wheel cover, the anti-jumping roller having a horizontal axle being vertical with the direction that the door leaf moves and an upper part of which protruding out of top face of said upper wheel cover;

said pulling unit is a pulling unit with double plates, which is comprised of a baseplate of pulling unit and a pillar plate of pulling unit mounted on the baseplate; a pulling pillar which is configured to pull said damper sliding unit is fixed vertically on said pillar plate of pulling unit;

both ends in longitudinal direction of said baseplate of pulling unit are cut into a plurality of longitudinal and parallel branch plates; each of the parallel branch plate has a connecting hole, and a connecting elastic unit is connected in parallel to the plurality of longitudinal and parallel branch plates;

said connecting elastic unit is comprised of a baseplate of elastic unit, a left erect plate and a right erect plate, wherein the left erect plate and the right erect plate are respectively fixed on both ends of said baseplate of elastic unit; said baseplate of elastic unit further comprises a plurality of sub-plates which are same in quantity as said branch plates at corresponding ends of said baseplate of pulling unit; and at least one sub-plate is raised or dent with relative to other sub-plates so that all said sub-plates are not in the same plane in order to achieve overlapping connection by some sub-plates fitting in top face of corresponding branch plates and other sub-plate fitting in bottom face of corresponding branch plates;

the plurality of sub-plates respectively fitting to the plurality of longitudinal and parallel branch plates so that said connecting elastic unit is connected to said baseplate of pulling unit; said sub-plates have assembly holes or raised heads fitting to said connecting holes of said branch plates;

lug bosses are respectively mounted on outer surfaces of said left erect plate and said right erect plate, and a vertical distance between the outer surface of said lug bosses of said left erect plate and the outer surface of said right erect plate is identical with a width of said upper track in vertical direction.

Preferably, both ends in longitudinal direction of said baseplate of pulling unit are cut into three longitudinal and parallel branch plates, and said baseplate of elastic unit of said connecting elastic unit is comprised of three sub-plates, the three sub plates being a left baseplate fixed to said left erect plate, a right baseplate fixed to said right erect plate, and a middle baseplate fixed between said left baseplate and said right baseplate.

Preferably, said left baseplate is located in the same plane with said right baseplate; said middle baseplate is raised with respect to said left baseplate and said right baseplate, such that said branch plate in the middle may fits to an bottom of said middle baseplate and said branch plates at both sides may respectively fit to top surfaces of said left baseplate and said right baseplate.

Preferably, said left baseplate and said right baseplate each has a raised head, said raised heads respectively being fitted to and connected to said connecting holes in two of said three longitudinal and parallel branch plates at sides; an assembly hole is provided on said middle baseplate to fit to said connecting hole in one of said three longitudinal and parallel branch plates in the middle, and a screw goes through said assembly hole and said connecting hole to achieve assembling.

Preferably, a guiding unit and an internal is provided upright on the baseplate of pulling unit, and a hex stud in parallel with the guiding unit are fixed on said baseplate of pulling unit; a guiding hole fitting to said guiding unit and a screw hole fitting to said internal hex stud are correspondingly mounted to said pillar plate of pulling unit, said guiding unit and said internal hex stud go through said guiding hole and said screw hole respectively, and a distance between said pillar plate of pulling unit and said baseplate of pulling unit may be adjustable by rotating said internal hex stud.

Preferably, said lug boss may be shaped as a cuboid.

Preferably, a "+" symbol-shaped groove hole is provided onto said upper wheel cover at an end onto which a groove for sliding is mounted, and said anti-jumping roller is arranged in said "+" symbol shaped groove hole.

Preferably, two dampers are arranged in parallel in longitudinal direction within said upper wheel cover on said upper wheel plate, and the heads of drawbars of said two dampers are connected to said damper sliding unit; said damper sliding unit has a plugging hole fitting to said pulling unit; a groove for sliding corresponding to said damper sliding unit is provided on aid upper wheel cover; said plugging hole is positioned in said groove for sliding, and said pulling unit is capable of passing through said groove for sliding and plug into said plugging hole.

Preferably, said damper sliding unit has a fitting pillar; a guiding groove used for guiding said fitting pillar is provided on inner surface of said upper wheel cover, said guiding groove having a bent portion at an end, and said bent portion and said damper sliding unit being structured such that said fitting pillar is fitted to said bent portion as sliding into said bent portion and can get out as sliding to opposite direction.

The present invention has the following advantages: special structured pulling unit with double plates is easy to be assembled in the upper track and very firm, in order that the pulling unit can function well and pull the damper sliding unit to move, and wherein the anti-jumping roller can prevent the door leaf from jumping at the time of being open and closed, to ensure the door leaf move smoothly, and the anti-jumping upper wheel device with double dampers is simple and compact in structure and is with low cost. Other advantages of the present invention will be described in the following preferred examples.

DETAILED DESCRIPTION OF THE INVENTION

Figure 1:
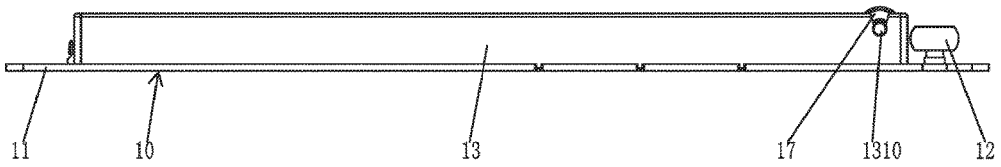
FIG. 1 is a front view of the anti-jumping upper wheel assembly with double dampers of the anti-jumping upper wheel device with double dampers.
Figure 2:
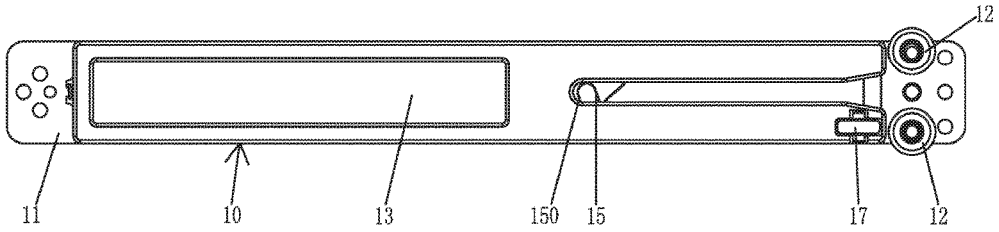
FIG. 2 is a top view of the anti-jumping upper wheel assembly with double dampers in FIG. 1.
Figure 3:
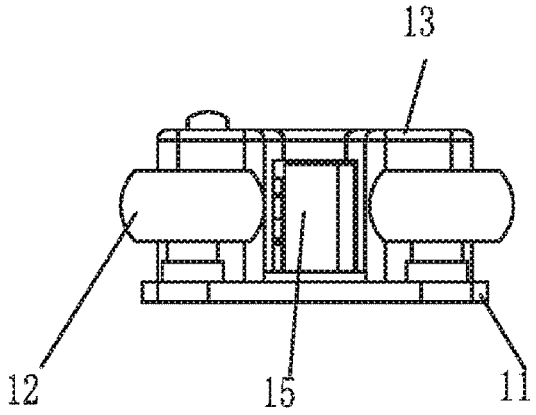
FIG. 3 is a left view of the anti-jumping upper wheel assembly with double dampers in FIG. 1.
Figure 4:
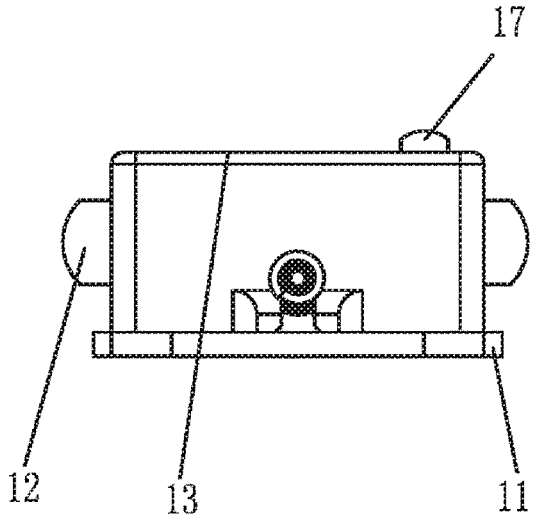
FIG. 4 is a right view of the anti-jumping upper wheel assembly with double dampers in FIG. 1.
Figure 5:
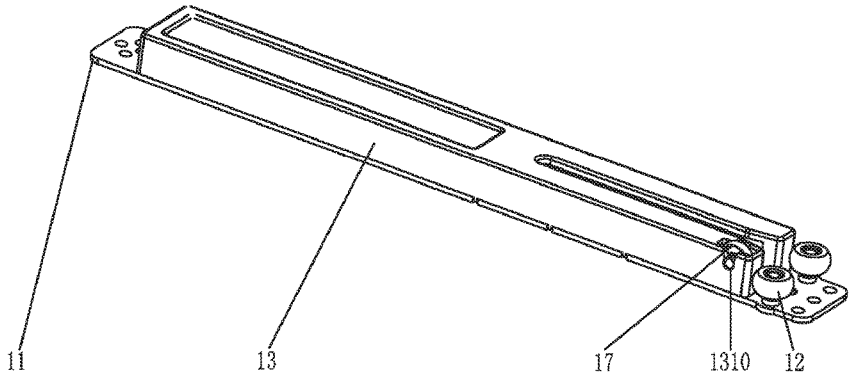
FIG. 5 is a graphic model of the anti-jumping upper wheel assembly with double dampers in FIG. 1.
Figure 6:
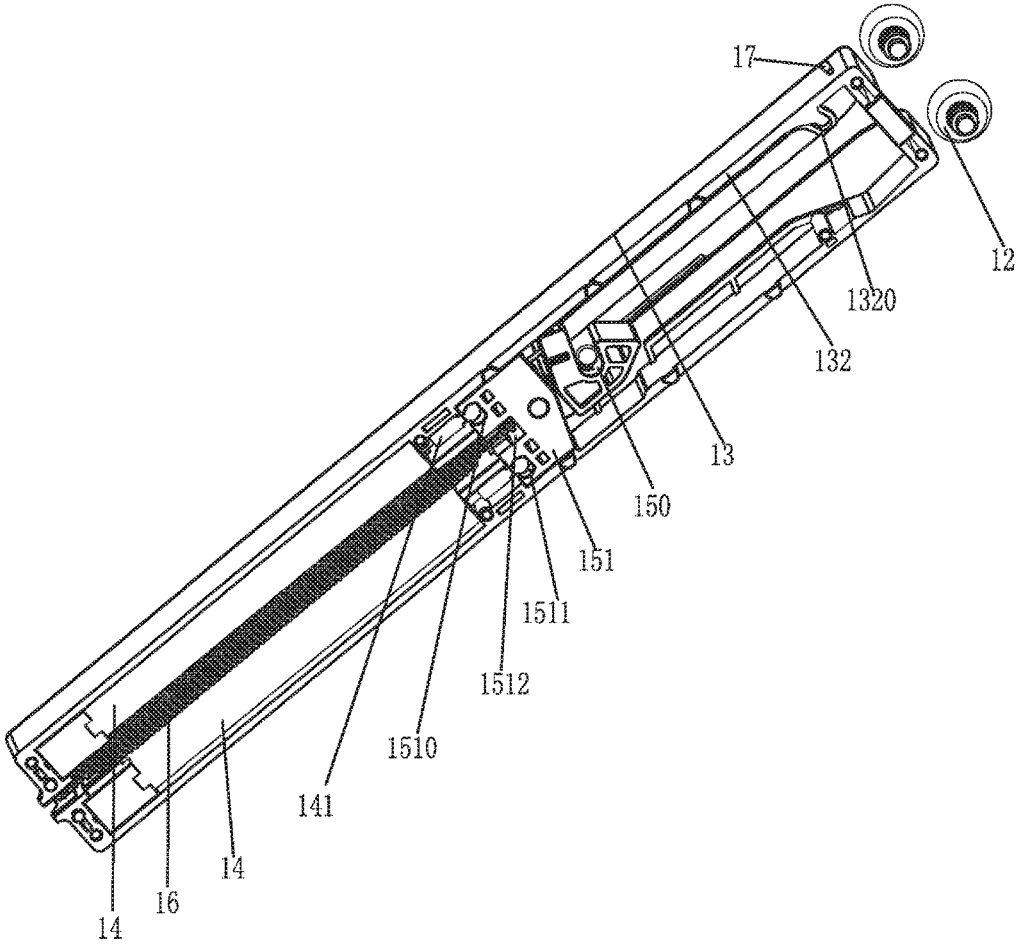
FIG. 6 is a graphic model of the anti-jumping upper wheel assembly with double dampers in FIG. 1 without the upper wheel plate, wherein its extension spring and dampers are in non tension state, and wherein an exploded view of position of the upper wheel is shown.
Figure 7:
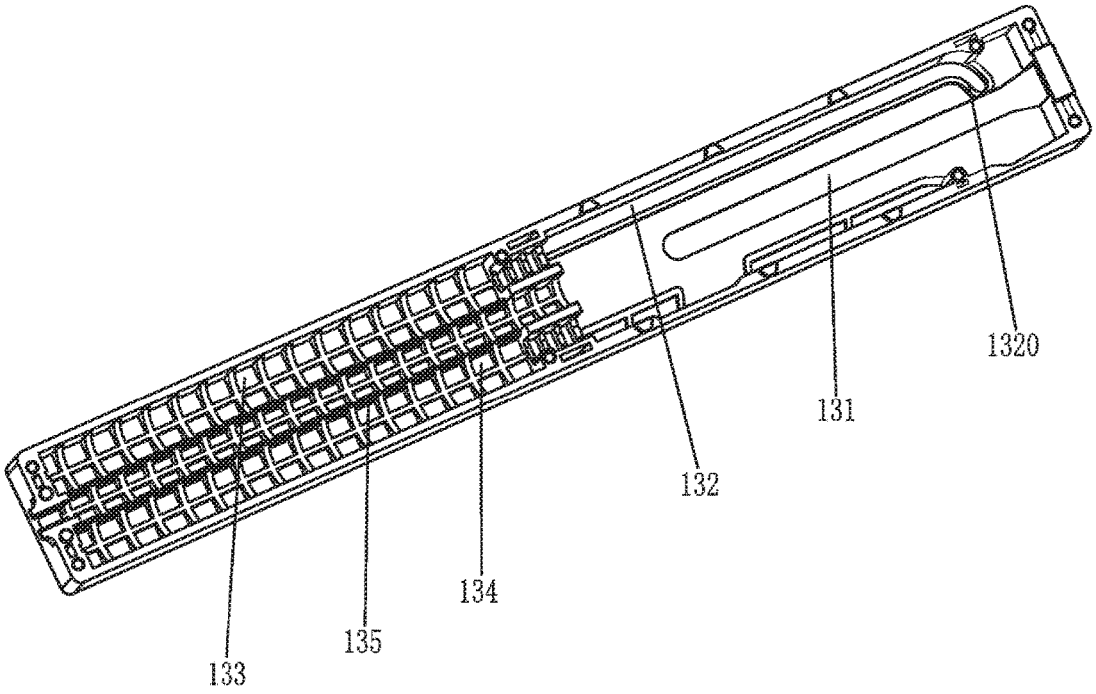
FIG. 7 is a diagrammatic sketch of the upper wheel cover of the anti-jumping upper wheel assembly with double dampers in FIG. 1.
Figure 8:
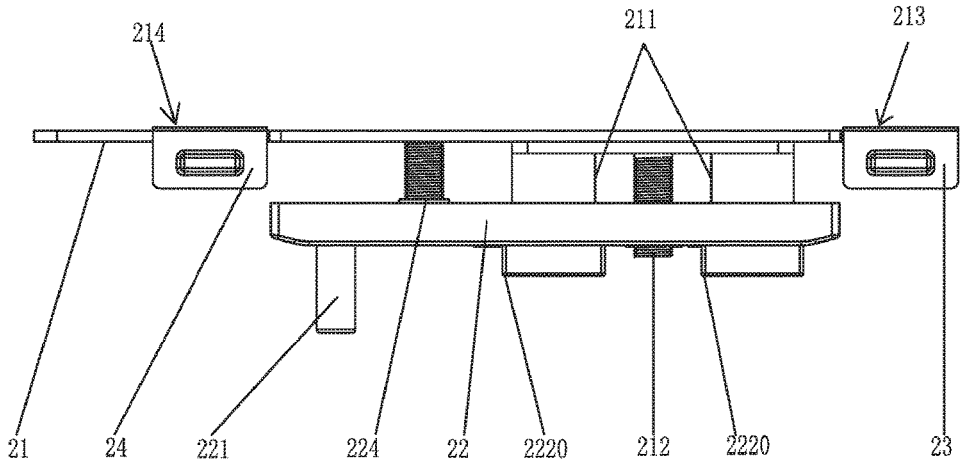
FIG. 8 is a front view of the pulling unit of the anti-jumping upper wheel device with double dampers, wherein the pulling unit is shown upside down.
Figure 9:
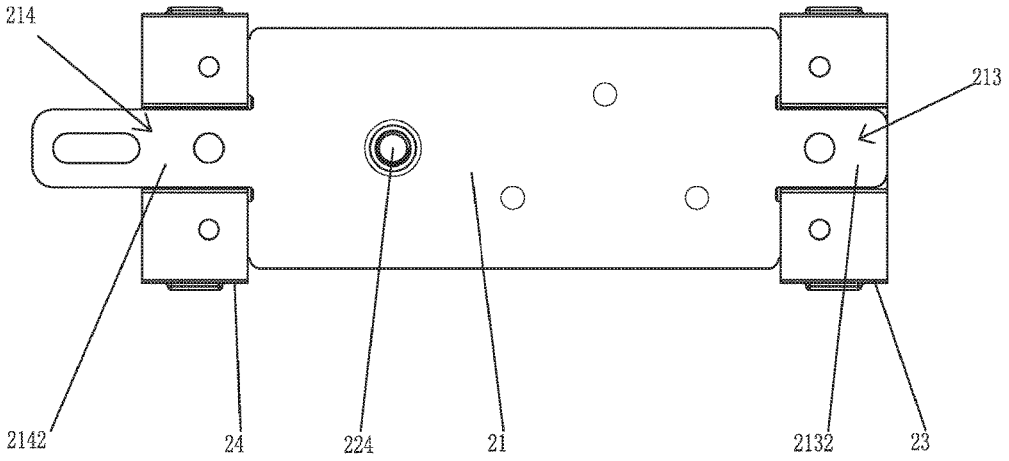
FIG. 9 is a top view of the pulling unit in FIG. 8.
Figure 10:
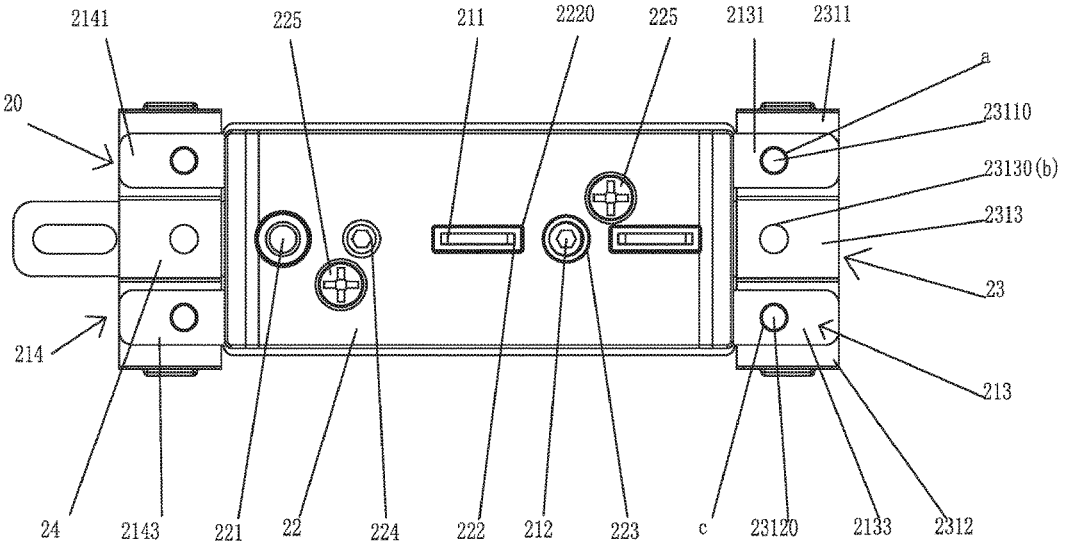
FIG. 10 is an upward view of the pulling unit in FIG. 8.
Figure 11:
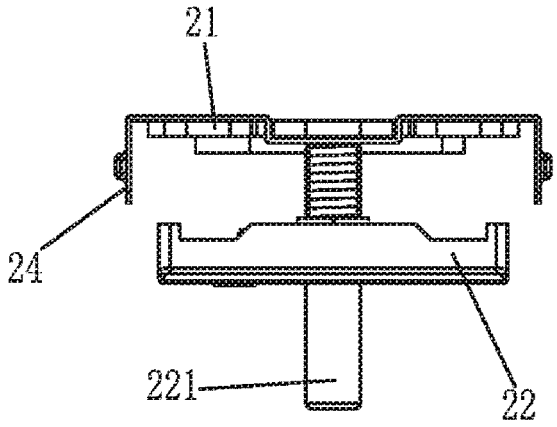
FIG. 11 is a right view of the pulling unit in FIG. 8.
Figure 12:
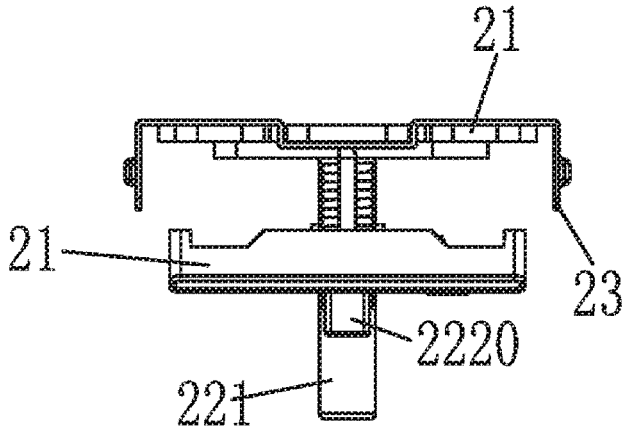
FIG. 12 is a left view of the pulling unit in FIG. 8.
Figure 13:
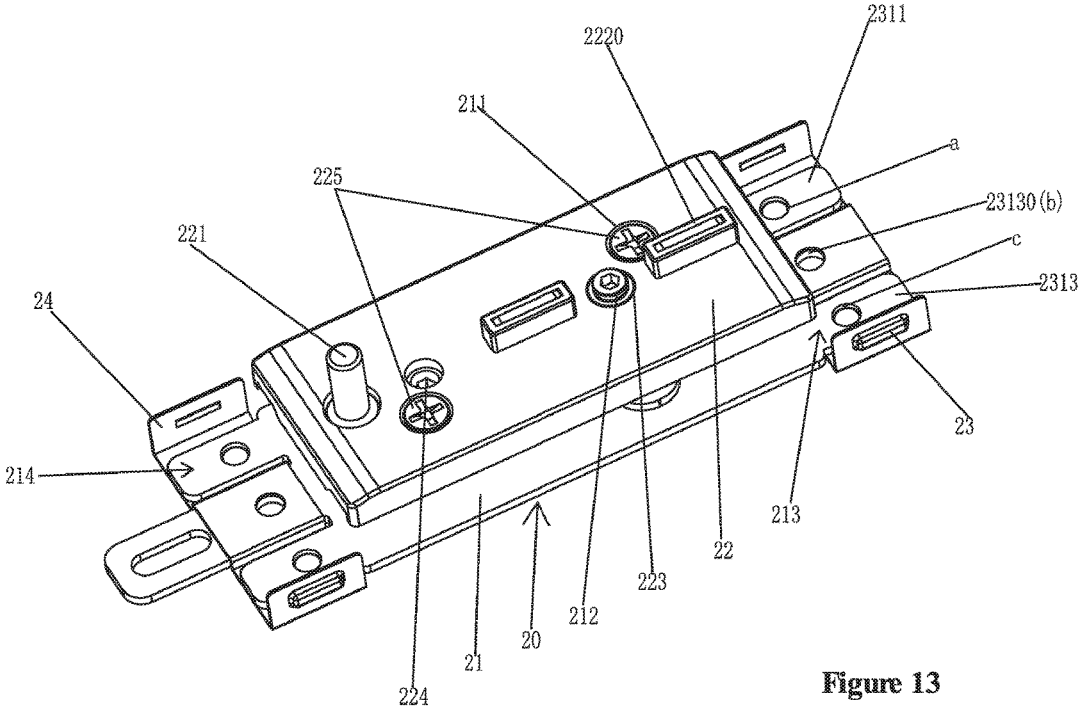
FIG. 13 is a graphic model of the pulling unit in FIG. 8.
Figure 14:
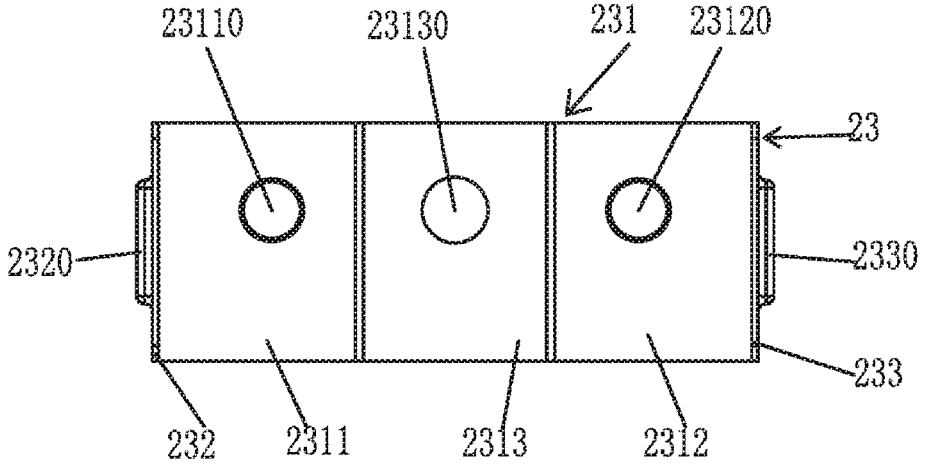
FIG. 14 is a front view of the connecting elastic unit of the pulling unit in FIG. 8.
Figure 15:
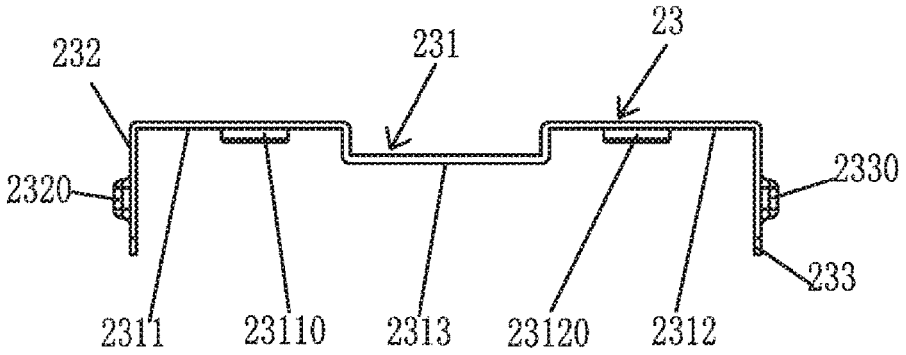
FIG. 15 is a top view of the connecting elastic unit in FIG. 14.
Figure 16:
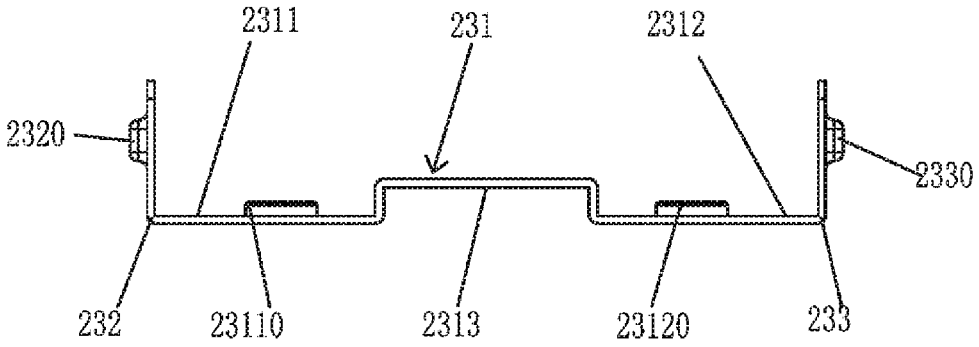
FIG. 16 is an upward view of the connecting elastic unit in FIG. 14.
Figure 17:
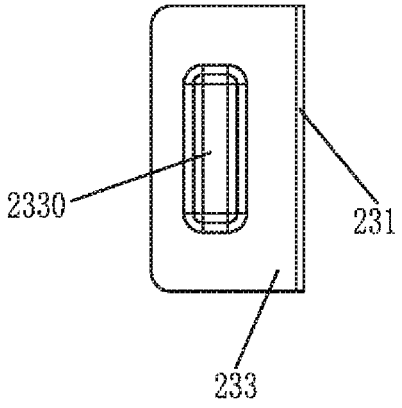
FIGS. 17 and 18 are respectively a left view and a right view of the connecting elastic unit in FIG. 14.
Figure 18:
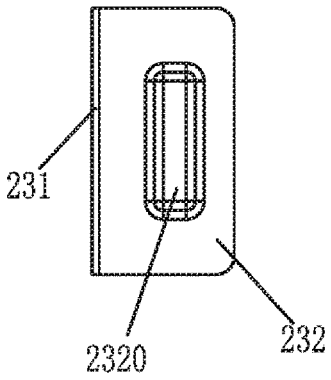
Figure 19:
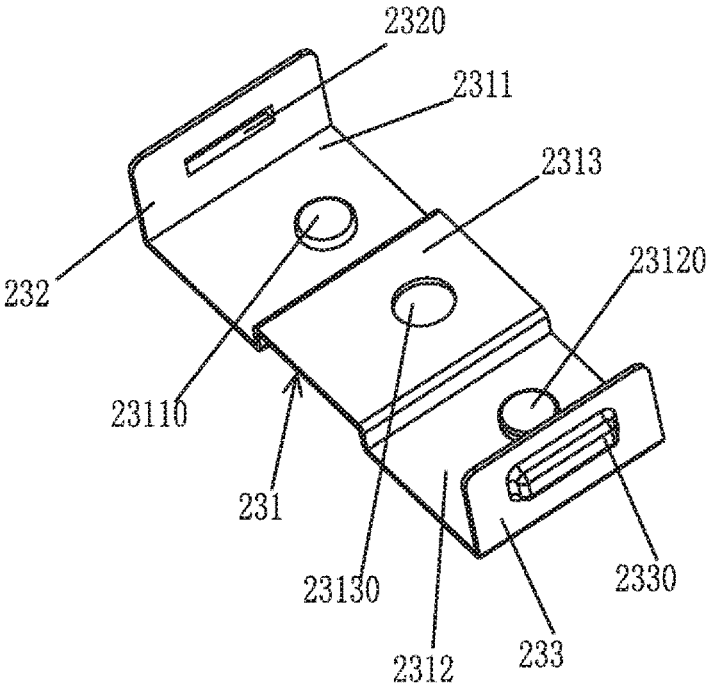
FIG. 19 is a graphic model of the connecting elastic unit in FIG. 14.

Components and parts represented by reference signs in the drawings are as follows.

Anti-jumping upper wheel assembly with double dampers 10, pulling unit 20;

upper wheel plate 11, upper wheel 12, upper wheel cover 13, damper 14, damper sliding unit 15, extension spring 16, groove for sliding 131, "+" symbol-shaped groove hole 1310, assembling groove 132, bent portion 1320, assembling grooves for dampers 133,134, assembling grooves for extension spring 135, plugging hole 150, connecting unit 151, connecting holes for drawbars of dampers 1510, 1511, connecting hole for extension spring 1512, anti-jumping roller 17;

baseplate of pulling unit 21, pillar plate of pulling unit 22, pulling pillar 221, guiding unit 211, internal hex stud 212, guiding hole 222, screw hole 223, extension part 2220, screw 224, screw 225, end in longitudinal direction 213, three longitudinal branch and parallel plates 2131, 2132, 2133, end in longitudinal direction 214, three longitudinal branch and parallel plates 2141, 2142, 2143, connecting holes a, b, c;

connecting elastic unit 24, connecting elastic unit 23, baseplate of elastic unit 231, left erect plate 232, right erect plate 233, left baseplate 2311, right baseplate 2312, middle baseplate 2313, raised heads 23110, 23120, assembly hole 23130, lug bosses 2320, 2330, door leaf of cupboard door A, upper track B.

Preferred embodiments of the present invention will be described in the following with the drawings.

Figure 20:
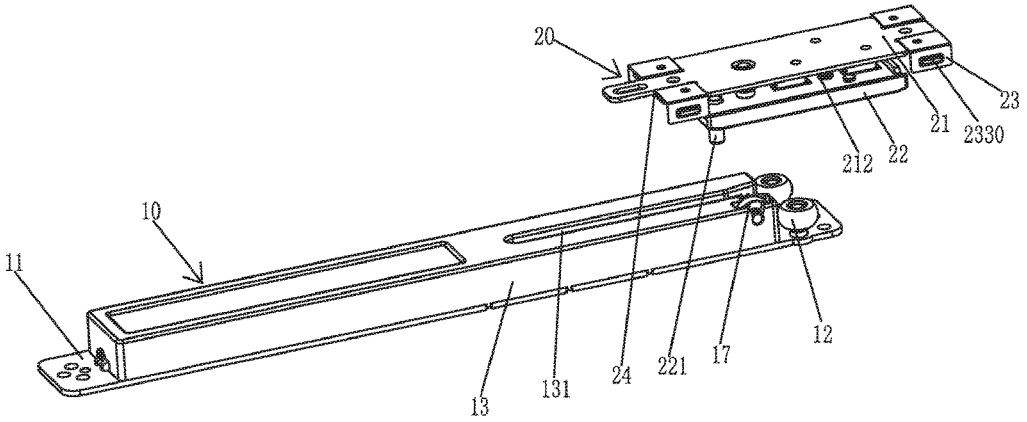
FIG. 20 is a whole view of the anti-jumping upper wheel device with double dampers of the present invention, wherein the anti-jumping upper wheel assembly with double dampers is apart with the pulling unit.
Figure 21:
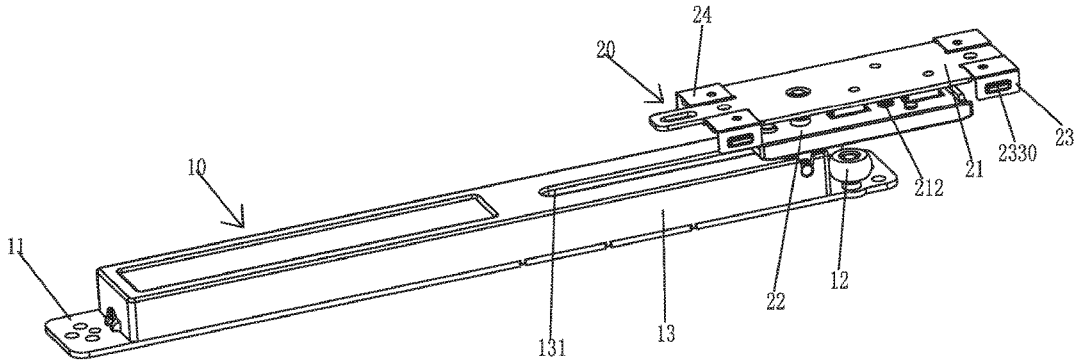
FIG. 21 is a whole view of the anti-jumping upper wheel device with double dampers of the present invention, wherein the pulling pillar of the pulling unit are plugged into the plugging hole of the damper sliding unit of the anti-jumping upper wheel assembly with double dampers.
Figure 22:
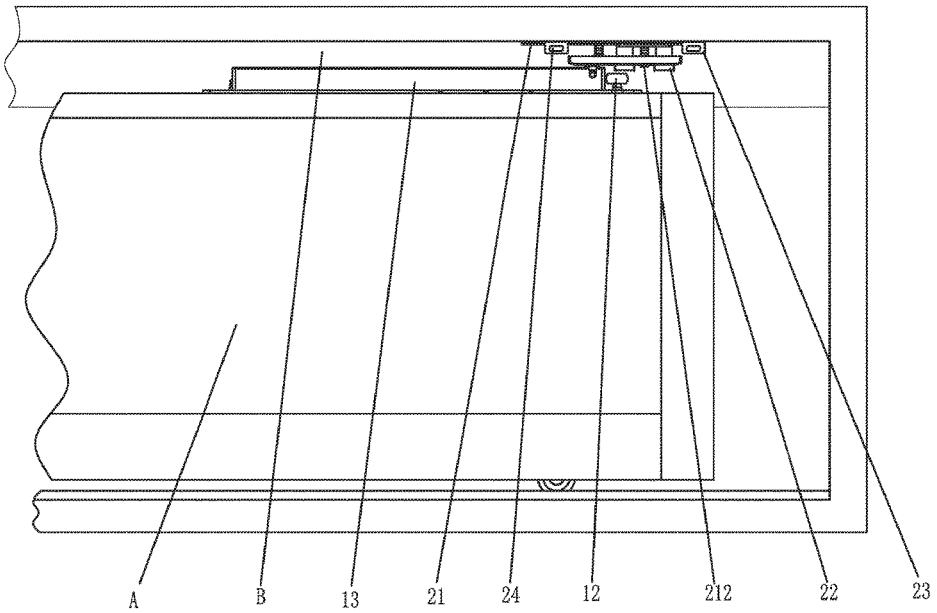
FIG. 22 is a diagrammatic view of the anti-jumping upper wheel device with double dampers of the present invention assembled respectively on the door leaf and the upper track.

FIG. 20 and FIG. 21 show whole views of the anti-jumping upper wheel device with double dampers of an embodiment of the present invention, which is comprised of two parts: an anti-jumping upper wheel assembly with double dampers 10 assembled at top end of the door leaf of a sliding door in use, and a pulling unit 20 assembled in the upper track in use. FIGS. 1 to 7 show the ant-jump upper wheel assembly with double dampers 10 and its components, FIGS. 8 to 13 show the pulling unit 20, and FIGS. 14 to 19 show the connecting elastic unit 23 of the pulling unit 20. FIG. 22 shows a diagrammatic view of the anti-jumping upper wheel device with double dampers being assembled to the door leaf A and the upper track B.

Next, the anti-jumping upper wheel assembly with double dampers 10 and the pulling unit 20 will be described respectively.

(I) The Anti-Jumping Upper Wheel Assembly with Double Dampers 10

As shown in FIGS. 1 to 8, the anti-jumping upper wheel assembly with double dampers 10 is comprised of an upper wheel plate 11, an upper wheel 12 and an upper wheel cover 13 mounted on the upper wheel plate 11, and a damper 14 an end of which is connected to a damper sliding unit 15 is mounted in longitudinal direction in the upper wheel cover 13 on the upper wheel plate 11. When the anti-jumping upper wheel assembly with double dampers 10 is assembled on the top end of the door leaf, the upper wheel 12 can fit to and slide along the upper track in which a door leaf is assembled.

Preferably, in the present invention, two dampers 14 are mounted in longitudinal direction in parallel in the upper wheel cover 13 on the upper wheel plate 11, the damper sliding unit 15 is connected to ends of drawbars of the two dampers, and damping effect is enhanced because of these two dampers. In addition, an extension spring 16 which can also be pulled and pushed by the damper sliding unit 15 is mounted in parallel with and between two dampers 14. Damper assembling grooves 133, 134 for two dampers 14 and an extension spring assembling groove 135 for the extension spring 16 are mounted in the upper wheel cover 13. The damper sliding unit 15 is connected with a connecting unit 151 which has connecting holes for dampers' drawbars 1510,1511 and a connecting hole for extension spring 1512, ends of the drawbars of two dampers 14 and the corresponding end of the extension spring 16 are respectively connected to the connecting holes for dampers' drawbars 1510,1511 and the connecting hole for extension spring 1512, in order that the dampers 14 and the extension spring 16 can be pulled and pushed by the damper sliding unit 15.

A groove for sliding 131 is mounted in the upper cover 13 at the position corresponding to the damper sliding unit 15, the groove for sliding 131 is mounted at longitudinal middle position of the upper wheel cover 13 i.e. middle position between two dampers 14, and aligns with position of the extension spring 16.

Wherein, damper sliding unit 15 has a plugging hole 150 and a fitting pillar. Wherein, the plugging hole 150 is positioned in the groove for sliding 131, so that the pulling pillar (will be described in the following) of the pulling unit 20 can go through the groove for sliding 131 and plug into the plugging hole 150 to pull the damper sliding unit 15. A guiding groove 132 for guiding the fitting pillar is mounted to inner surface of the upper wheel cover 13, the guiding groove 132 has a bent portion 1320 at the last end which fits to the above-mentioned fitting pillar of the damper sliding unit 15, and the bent portion 1320 and the damper sliding unit 15 are proper structured in order that the fitting pillar can be fitted and locked in the bent portion 1320 when it slides into the bent portion 1320 and at which moment the extension spring 16 reaches to its maximum and the damper 14 is "strung", and the fitting pillar can get out of the bent portion 1320 when it is being pushed on reverse direction and at this moment the damper is "unhooked" and acts damping effect. The damper sliding unit should have proper structure to satisfy the above mentioned requirements of function and assembly, Chinese patent No. ZL201320065103.7 provides a preferred example of the damper sliding unit whose technical solution can be cited in the present invention and will not be described in detail, and the present invention of course can use other equivalent structures.

At the minute that the door leaf is being closed and open, the door leaf will jump tempestuously because of a very strong accelerated speed brought then and a gap between the assembled door leaf and the upper track. The applicant thus provides an easy and reliable solution as follows after tests for times.

An anti-jumping roller 17 is mounted in the upper wheel cover 13, a fixed axle of which is vertical with direction that the door leaf moves (longitudinal direction of the anti-jumping upper wheel assembly with double dampers 10), and the anti-jumping roller rotates around the fixed axle; moreover, an upper part of the anti-jumping roller 17 protrudes out of top face of the upper wheel cover. The anti-jumping roller 17 is a general rotatable wheel, and preferably a plastic wheel, the height thereof protruding out of the top face of the upper wheel cover 13 is equal to distance between the top face of upper wheel cover 13 and surface of a pillar plate of pulling unit of the pulling unit 20 which will be described in the following, the anti-jumping roller 17 rotates on the pillar plate of pulling unit along the direction that the door leaf moves and accordingly the door leaf has no space to jump, therefore the door leaf jumping at the time of being opened and closed is avoid, and a very great effect is obtained with applying. As a preferred embodiment, a "+" symbol shaped groove hole 1310 is mounted to the upper wheel cover in the end to which the groove for sliding 131 is mounted, and the anti-jumping roller 17 is assembled in the "+" symbol shaped groove hole 1310.

(II) The Pulling Unit 20

As shown in FIGS. 9 to 14, the pulling unit 20 is a pulling unit with double plates, which is comprised of a baseplate of pulling unit 21 and a pillar plate of pulling unit 22 assembled below the baseplate of pulling unit 21; a pulling pillar 221 fitting to the plugging hole 150 of the damper sliding unit 15 is fixed vertically on the face of pillar plate of pulling unit 22.

Wherein, the pulling pillar 221 is a very important functional part, and it can be inserted into the plugging hole 150 to pull the damper sliding unit 15 and make the damper 14 "strung", can get out of the plugging hole 150 when moving on after the damper is "strung", and can force the damper sliding unit on reverse direction of sliding to make the damper act damping function. Actual length of the pulling pillar 221 is usually not the effective length plugged into the plugging hole 150 because of limit by assemble, but the structure of double plates can make the pillar plate of pulling unit 22 be closer to the top of the door leaf in order to increase the effective length of the pulling pillar while the baseplate of pulling unit 21 is assembled to the top surface of the upper track.

Preferably, vertically upright guiding units 211 and an internal hex stud 212 in parallel therewith are fixed on the baseplate of pulling unit 21, guiding holes 222 fitting to the guiding units 221 and a screw hole 223 fitting to the internal hex stud 212 are correspondingly mounted to the pillar plate of pulling unit 22, and the guiding units 211 and the internal hex stud 212 go through the guiding holes 222 and the screw hole 223 respectively to protrude out of the pillar plate of pulling unit 22; more preferably, an extension part 2220 for each guiding unit 211 is mounted around the respective guiding hole 222 on the pillar plate of pulling unit 22. In the present embodiment, preferably, two guiding units 211 are mounted, and more preferably, the guiding units are cuboid; and one end of the internal hex stud 212 is restricted in the baseplate of pulling unit 21 and can only rotate.

In addition, the pillar plate of pulling unit 22 is comprised of a plastic board and a metal baseplate overlapped both of which are fixed together by a screw marked by 224 in figures from bottom to top and a screw marked by 225 from top to bottom.

Turn around the above-mentioned internal hex stud 212, driving it to mesh transmission with the screw hole 223, the pillar plate of pulling unit 22 thus moves upward or downward with relative to the baseplate of pulling unit 21, and the effective length of the pulling pillar 221 fixed on the pillar plate of pulling unit 22 will be elongated or shorten in order that it can fit to the damper sliding unit 15 and plug into the plugging hole 150 and therefore can pull the damper sliding unit 15 effectively to work; and whole height of the pulling unit 20 can also be adjusted to fit different assembly width.

Preferably, in order to fix the pulling unit 20 on the upper track, the end 213 in longitudinal direction of the baseplate of pulling unit 21 is cut into three longitudinal branch and parallel plates 2131, 2132, 2133, the end 214 in longitudinal direction of the baseplate of pulling unit 21 is cut into three longitudinal branch and parallel plates 2141, 2142, 2143, and a connecting hole is mounted to each branch plate of each end in longitudinal direction; a connecting elastic unit 23 and a connecting elastic unit 24 are respectively connected to the three longitudinal branch and parallel plates of both ends of the baseplate of pulling unit 21. Since structure of the end 213 in longitudinal direction and the connecting elastic unit thereon are mainly identical with that of the end 214 in longitudinal direction and the connecting elastic unit thereon, thus only take the end 213 in longitudinal direction for example to illustrate the structures next.

As shown in FIGS. 9 to 14, three longitudinal branch and parallel plates 2131, 2132, 2133 of the end 213 in longitudinal direction of the baseplate of pulling unit 21 respectively has a connecting hole a, b, c, the connecting elastic unit 23 is connected to the three longitudinal branch and parallel plates, and the connecting elastic unit 23 is made of elastic material which is good for assembly in the upper track steadily.

As shown in FIGS. 15 to 20, the connecting elastic unit 23 is comprised of a baseplate of elastic unit 231, and a left erect plate 232 and a right erect plate 233 which are respectively fixed on both ends of the baseplate of elastic unit 231, the baseplate of elastic unit 231 has a left baseplate 2311 fixed with the left erect plate 232, a right baseplate 2312 fixed with the right erect plate 233, and a middle baseplate 2313 mounted between the left baseplate 2311 and the right baseplate 2312. The connecting elastic unit 23 is made in a whole.

Wherein, the left baseplate 2311, the middle baseplate 2313 and the right baseplate 2312 respectively fit to the branch plates 2131, 2132, 2133 in parallel in longitudinal direction, in order that the connecting elastic unit 23 can be overlapped and connected to the baseplate of pulling unit 21; each of the left baseplate 2311, the middle baseplate 2313 and the right baseplate 2312 has an assembly hole or a raised head fitting to the connecting holes a, b, c of the corresponding branch plate.

In the present example, the left baseplate 2311 and the right baseplate 2312 are in the same plane, the middle baseplate 2313 raises from the left baseplate 2311 and the right baseplate 2312, so that the middle branch plate 2132 can fit to bottom of the middle baseplate 2313 and the branch plates 2131, 2133 in both sides can fit to top of the left baseplate 2311 and the right baseplate 2312 as connecting in parallel. The left baseplate 2311 and the right baseplate 2312 respectively have raised heads 23110, 23120 which respectively fit to and connect to the connecting holes a, c of two branch plates 2131, 2133 in both sides of the three longitudinal branch and parallel plates; the middle baseplate 2313 has an assembly hole 23130 fitting to the connecting hole b of the branch plate 2132 in the middle of the three longitudinal branch and parallel plates, and a screw passes through the assembly hole 23130 and the connecting hole b to assemble.

Of course, in the present example of the present invention, the middle baseplate can dent with relative to the left and the right baseplates, so that the branch plate in the middle can fit to top of the middle baseplate and the branch plates in two sides can respectively fit to bottom of the left and the right baseplate when connecting in parallel. In other examples of the present invention, it also can be that one of the left, the middle and the right baseplates has an assembly hole to connect with corresponding branch plate by screw and the other two of them has raised heads to connect in the connecting hole of corresponding branch plates; and the like.

In other examples of the present invention, both ends in longitudinal direction of the baseplate of pulling unit can be cut into more than three longitudinal branch and parallel plates in some situations, each of which has a connecting hole; and a connecting elastic unit is overlapped and connected in parallel to the more than three longitudinal branch and parallel plates of each end in longitudinal direction of the baseplate of pulling unit. Accordingly, elastic baseplate of the connecting elastic unit has more than three corresponding sub-plates which is same in quantity with the branch plates of corresponding end of the baseplate of pulling unit, and therein at least one sub-plate is raised or dent with relative to other sub-plates so that all the sub-plates are not in the same plane in order to achieve overlapping connection by some sub-plates fitting in top face of corresponding branch plate and other sub-plates fitting in bottom face of corresponding branch plate. Then the raised head as in the above mentioned example wedges in the connecting hole of the branch plate or the screw passes through corresponding connecting hole and assembly hole to assemble.

In addition, in the present embodiment, a lug boss 2320 and a lug boss 2330 are respectively mounted on outer surfaces of the left erect plate 232 and the right erect plate 233, vertical distance between the outer surface of the lug boss 2320 of the left erect plate and the outer surface of the lug boss 2330 of the right erect plate are identical with vertical width of the upper track. Preferably, both lug bosses are cuboid. For assembling, the pulling unit with double plates 20 are assembled upside down in the upper track with the baseplate of elastic unit 231 pressing against bottom of the upper track, and the lug bosses 2320, 2330 mentioned above respectively press against left and right sides of the upper track so that the pulling unit can be moved easily because of the structure of lug boss in need of adjusting position of the pulling unit 20 in the upper track.

Method to assemble the pulling unit with double plates in the upper track will be introduced next. First, mount the pulling unit with double plates 20 far from side of the door frame as possible when assembling the pulling unit with double plates 20 upside down in the upper track B, as final position thereof is not confirmed now. The pulling pillar 221 of the pulling unit with double plates 20 does not contact the damper sliding unit 15 of the anti-jumping upper wheel assembly with double dampers 10 when the door leaf A is being pulled from side to middle of the door frame, and then when the door leaf A is moved on from middle to the other side of the door frame the damper sliding unit 15 of the upper wheel assembly with double dampers 10 will contact the pulling pillar 221 and pull the pulling unit with double plates 20 toward the side of the door frame until reach it, and the pulling unit with double plates 20 is located voluntarily at this position. Then we can screw the internal hex stud 212 by hex s-screwdriver to press the internal hex stud 212 against top of the upper track and thus fix the pulling unit with double plates 20.

Action mechanism of the anti-jumping upper wheel device with double dampers of the present invention will be introduced next.

Referring to FIG. 22, when the door leaf A is at side of the door frame, the pulling pillar 22 of the pulling unit with double plates 20 in the upper track B is plugged in the plugging hole 150 of the damper sliding unit 15 of the upper wheel assembly with double dampers 10, when the door leaf A is being pulled from right to left the pulling pillar 221 pulls the damper sliding unit 15 to make the damper "strung" and then the door leaf A moves on to left, the pulling pillar 221 get out of the damper sliding unit 15 and the door leaf A slides free. When the door leaf A is being pushed from left to right as it is being closed, the pulling pillar 221 collides with the damper sliding unit 15 and makes the damper sliding unit 15 "unhooked" when the upper wheel assembly with double dampers 10 slides to below of the pulling unit with double plates 20, and at this time the dampers of the upper wheel assembly with double dampers 10 functions to force the door leaf on reverse direction, the door leaf A will thus move smoothly without jumping and collision to reach edge of the door frame safely.

Advantages of the anti-jumping upper wheel device with double dampers of the present example are as follows: (i) it is novel in design and is proper structured; (ii) height of the pulling pillar can be adjusted; (iii) it can be assembled easily: because the connecting elastic unit is mounted at both sides of the baseplate of pulling unit of the pulling unit with double plates, which is made of material with high elasticity and which has cuboid lug bosses on the left and the right erect plates, the pulling unit with double plates thus can be assembled in the upper track with the connecting elastic unit pressing against both inner surface of the upper track steadily without falling off, and can also be pulled and pushed to move in the upper track; (iv) position of the pulling unit with double plates can be located voluntarily without manual work because of the improved structure of the baseplate of pulling unit; and (v) the anti-jumping upper wheel with double dampers has function of damping and anti-jumping.

The above mentioned is only preferred examples of the present invention and is not intended to limit protection coverage of the present invention, and any equivalent transformation and substitution of the technical solution of the present invention is in the protection coverage of the present invention.

What is claimed is:

1. An anti-jumping upper wheel device with double dampers comprising an anti-jumping upper wheel assembly with double dampers;

a pulling unit;

wherein the anti-jumping upper wheel assembly comprises an upper wheel plate, an upper wheel and an upper wheel cover, wherein the upper wheel and the upper wheel cover are mounted on said upper wheel plate; dampers are connected to a damper sliding unit at an end and mounted in longitudinal direction in said upper wheel cover on said upper wheel plate;

the pulling unit is adapted for an upper track in which a door leaf is mounted, such that the pulling unit is capable of pulling said damper sliding unit; wherein, an extension spring is mounted in parallel with and between said two dampers; a connecting unit is connected to said damper sliding unit, and heads of drawbars of said dampers and a corresponding end of said extension spring are connected to said connecting unit;

an anti-jumping roller is mounted onto said upper wheel cover, wherein the anti-jumping roller having a horizontal axle which is perpendicular to a longitudinal direction of the anti-jumping upper wheel assembly with double dampers and an upper part of the anti-jumping roller protrudes out of top face of said upper wheel cover;

said pulling unit has double plates, wherein each of the plates is comprised of a baseplate of pulling unit and a pillar plate of pulling unit mounted on the baseplate; a pulling pillar which is configured to pull said damper sliding unit is fixed vertically on said pillar plate of pulling unit;

both ends in longitudinal direction of said baseplate of pulling unit are cut into a plurality of longitudinal and parallel branch plates; each of the parallel branch plates has a connecting hole, and a connecting elastic unit is connected in parallel to the plurality of longitudinal and parallel branch plates;

said connecting elastic unit is comprised of a baseplate of elastic unit, a left erect plate and a right erect plate, wherein the left erect plate and the right erect plate are respectively fixed on both ends of said baseplate of elastic unit; said baseplate of elastic unit further comprises a plurality of sub-plates which are same in quantity as said branch plates at corresponding ends of said baseplate of pulling unit; and at least one sub-plate is raised or dented with relative to other sub-plates so that all said sub-plates are not in the same plane in order to achieve overlapping connection by some sub-plates fitting in top face of corresponding branch plates and other sub-plate fitting in bottom face of corresponding branch plates;

the plurality of sub-plates respectively fitting to the plurality of longitudinal and parallel branch plates so that said connecting elastic unit is connected to said baseplate of pulling unit; said sub-plates have assembly holes or raised heads fitting to said connecting holes of said branch plates;

lug bosses are respectively mounted on outer surfaces of said left erect plate and said right erect plate, and a vertical distance between the outer surface of said lug bosses of said left erect plate and the outer surface of said right erect plate is identical with a width of said upper track in vertical direction.

2. The anti-jumping upper wheel device with double dampers of claim 1, wherein both ends in longitudinal direction of said baseplate of pulling unit are cut into three longitudinal and parallel branch plates, and said baseplate of elastic unit of said connecting elastic unit is comprised of three sub-plates, the three sub plates being a left baseplate fixed to said left erect plate, a right baseplate fixed to said right erect plate, and a middle baseplate fixed between said left baseplate and said right baseplate.

3. The anti-jumping upper wheel device with double dampers of claim 2, wherein said left baseplate is located in the same plane with said right baseplate; said middle baseplate is raised with respect to said left baseplate and said right baseplate, such that said branch plate in the middle fits to an bottom of said middle baseplate and said branch plates at both sides respectively fit to top surfaces of said left baseplate and said right baseplate.

4. The anti-jumping upper wheel device with double dampers of claim 3, wherein said left baseplate and said right baseplate each has a raised head, said raised heads respectively being fitted to and connected to said connecting holes in two of said three longitudinal and parallel branch plates at sides; an assembly hole is provided on said middle baseplate to fit to said connecting hole in one of said three longitudinal and parallel branch plates in the middle, and a screw goes through said assembly hole and said connecting hole to achieve assembling.

5. The anti-jumping upper wheel device with double dampers of claim 1, wherein a guiding unit and an internal is provided upright on the baseplate of pulling unit, and a hex stud in parallel with the guiding unit are fixed on said baseplate of pulling unit; a guiding hole fitting to said guiding unit and a screw hole fitting to said internal hex stud are correspondingly mounted to said pillar plate of pulling unit, said guiding unit and said internal hex stud go through said guiding hole and said screw hole respectively, and a distance between said pillar plate of pulling unit and said baseplate of pulling unit is adjustable by rotating said internal hex stud.

6. The anti-jumping upper wheel device with double dampers of claim 1, wherein said lug boss is shaped as a cuboid.

7. The anti-jumping upper wheel device with double dampers of claim 1, wherein a "+" symbol-shaped groove hole is provided onto said upper wheel cover at an end onto which a groove for sliding is mounted, and said anti-jumping roller is arranged in said "+" symbol shaped groove hole.

8. The anti-jumping upper wheel device with double dampers of claim 1, wherein two dampers are arranged in parallel in longitudinal direction within said upper wheel cover on said upper wheel plate, and the heads of drawbars of said two dampers are connected to said damper sliding unit; said damper sliding unit has a plugging hole fitting to said pulling unit; a groove for sliding corresponding to said damper sliding unit is provided on said upper wheel cover; said plugging hole is positioned in said groove for sliding, and said pulling unit is capable of passing through said groove for sliding and plug into said plugging hole.

9. The anti-jumping upper wheel device with double dampers of claim 8, wherein said damper sliding unit has a fitting pillar; a guiding groove used for guiding said fitting pillar is provided on inner surface of said upper wheel cover, said guiding groove having a bent portion at an end, and said bent portion and said damper sliding unit being structured such that said fitting pillar is fitted to said bent portion as sliding into said bent portion and is capable of getting out from the bent portion as sliding to an opposite direction.

* * * * *